US007821189B2

(12) United States Patent
Peng et al.

(10) Patent No.: US 7,821,189 B2
(45) Date of Patent: Oct. 26, 2010

(54) METHOD FOR MAINTAINING VACUUM-TIGHT INSIDE A PANEL MODULE AND STRUCTURE FOR THE SAME

(75) Inventors: Chih-Ping Peng, Hsinchu (TW); Yun-Jiau Shiau, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 728 days.

(21) Appl. No.: 11/434,888

(22) Filed: May 17, 2006

(65) Prior Publication Data

US 2007/0210695 A1 Sep. 13, 2007

(30) Foreign Application Priority Data

Mar. 10, 2006 (TW) ..... 95108097 A

(51) Int. Cl.
*H01J 1/62* (2006.01)

(52) U.S. Cl. ..... 313/495; 313/496; 313/497

(58) Field of Classification Search ..... 313/495–497
See application file for complete search history.

(56) References Cited

U.S. PATENT DOCUMENTS 5,797,780 A * 8/1998 Peng ..... 445/25
5,844,360 A * 12/1998 Jeong et al. ..... 313/495
6,039,620 A * 3/2000 Itoh et al. ..... 445/25
6,407,500 B1 * 6/2002 Tsuburaya et al. ..... 313/495
6,623,593 B2 * 9/2003 Igeta ..... 156/293
2002/0059977 A1 * 5/2002 Igeta ..... 156/182
2004/0242114 A1 * 12/2004 Nakata et al. ..... 445/24
2005/0047733 A1 * 3/2005 Hwang et al. ..... 385/94
2005/0191928 A1 * 9/2005 Jang ..... 445/25

* cited by examiner

*Primary Examiner*—Bumsuk Won
(74) *Attorney, Agent, or Firm*—Bacon & Thomas, PLLC

(57) ABSTRACT

This invention provides a method for maintaining vacuum of a panel module and a structure of the panel module. A sealing material is suspended inside the panel module right above an exhaust opening of the panel module connecting with an exhaust tube. After exhausting the inside of the panel module, the sealing material is heated and molten so as to drop down to seal the exhaust tube. As such, the panel module becomes vacuum-tight. During a subsequent annealing process to heat the exhaust tube to its melting temperature, ambient air is prohibited from flowing into the panel module.

9 Claims, 8 Drawing Sheets

METHOD FOR MAINTAINING VACUUM-TIGHT INSIDE A PANEL MODULE AND STRUCTURE FOR THE SAME

BACKGROUND OF THE INVENTION

1. Field of the Invention

The present invention relates to a panel module; and more particularly to a method for maintaining vacuum-tight of a panel module.

2. Description of the Related Art

Panel modules have become a crucial element of a display. The vacuum inside the panel module is highly required and important, which decays performance of components inside the panel module. During the manufacturing process of the panel module, after exhausting inside of the panel module and completing aging process, an exhaust tube connected to the panel module is burnt out and sealed by hydrogen-oxygen torch to maintain vacuum inside the panel module and also assure normal functions of the components inside the panel module. However, because the pressure inside the panel module is smaller than the pressure outside the panel module during an annealing process to use the hydrogen-oxygen torch to heat and seal the exhaust tube, ambient air will flow into the panel module to decrease the vacuum inside the panel module. The performance and functions of the components inside the panel module thus decay.

FIG. 3A and FIG. 3B explains a bottleneck for maintaining vacuum-tight inside a conventional panel module. FIG. 3A is a schematic cross-sectional view of the conventional panel module, in which an exhaust opening of the panel module is connected to a glass tube for exhausting the air inside the panel module. The panel module includes a first substrate 10*a*, a second substrate 10*b* and a side frame 11 disposed between the first substrate 10*a* and the second substrate 10*b*. An exhaust opening 10*c* is formed in the second substrate 10*b* to connect to one end of the glass tube 40 serving as an exhaust tube. The other end of the glass tube is connected to a pumping system 50. The air inside the panel module is exhausted by the pumping system 50 through the exhausting opening 10*c* and the glass tube 40. After exhausting the inside of the panel module, the glass tube 40 is burnt out and sealed by the annealing process with hydrogen-oxygen torch so as to meet the demand of the vacuum inside the panel module.

However, during the annealing process to use the hydrogen-oxygen torch to heat the glass tube 40 to gradually shrink one end of the glass tube 40, ambient air will flow into the panel module and the vacuum inside the panel module deteriorates. The quality and performance of the components inside the panel module are adversely affected. Accordingly, a method for effectively maintaining the vacuum inside the panel module is desired.

SUMMARY OF THE INVENTION

One objective of the present invention is to provide a method for maintaining vacuum-tight of a panel module, by which a sealing material is suspended within the panel module right above an exhaust opening of a substrate of the panel module, when the air inside the panel module is exhausted to attain a predetermined vacuum, the sealing material is heated and molten to drop down to seal an exhaust tube connected to the exhaust opening, and during a subsequent annealing process for burning out the exhaust tube, ambient air is prohibited from flowing into the inside of the panel module such that the panel module becomes vacuum-tight.

For achieving the above objective, the present invention provides a method for maintaining vacuum-tight of a panel module, which comprises providing a panel module at least including a first substrate, a second substrate and a side frame, the side frame disposed between the first substrate and the second substrate, and the second substrate having an exhaust opening; suspending a sealing material within the panel module such that the sealing material is placed right above the exhaust opening; connecting an exhaust tube to the exhaust opening of the second substrate; exhausting inside of the panel module via the exhaust tube so that the inside of the panel module attains a predetermined vacuum; heating the sealing material such that the sealing material is molten, and dropping down to seal the exhaust tube, thereby the inside of the panel module becomes sealing-tight; and burning out the exhaust tube.

In one another aspect, the present invention provides a high vacuum panel module including a first substrate, a second substrate having an exhaust opening, a side frame disposed between the first substrate and the second substrate, an exhaust tube connected to the exhaust opening, and a sealing material sealing the exhaust tube. By the sealing material sealing the exhaust tube, the inside of the panel module becomes vacuum-tight so as to prohibit ambient air from flowing into the inside of the panel module during a subsequent annealing process for burning out the exhaust tube.

It is preferable that the sealing material is an inorganic material.

It is preferable that the sealing material is heated by high frequency waves to be molten and then drop down to seal the exhaust tube.

It is preferable that the sealing material has a melting point in a range of 420° C. to 450° C.

It is preferable that the sealing material is suspended by a conductive member.

The present invention suspends the sealing material inside the panel module right above the exhaust opening. After exhausting the inside of the panel module, the sealing material is heated and molten to drop down to seal an exhaust tube connected to the exhaust opening. As such, the inside of the panel module becomes sealing-tight. The present method is simple and easy to accomplish, which can resolve the problem of flow back of ambient air during an annealing process subsequent to exhausting the air inside the panel module. The present invention improves manufacturing yield of the panel modules.

DETAILED DESCRIPTION OF THE PREFERRED EMBODIMENTS

The present invention provides a method for maintaining vacuum-tight inside a panel module, which suspends a sealing material within the panel module right above an exhaust opening of a substrate. When the inside of the panel module is exhausted to attain a predetermined vacuum, the sealing material is heated and molten to drop down to seal an exhaust tube connecting to the exhaust opening so as to prohibit ambient air from flowing into the panel module. Once the sealing material is hardened, the rest of the exhaust tube is burnt out, and a finished product of the panel module with vacuum-tight is provided.

The present method for maintaining vacuum-tight inside the panel module will be described in detail according to following embodiments with reference to accompanying drawings.

Figure 1A:
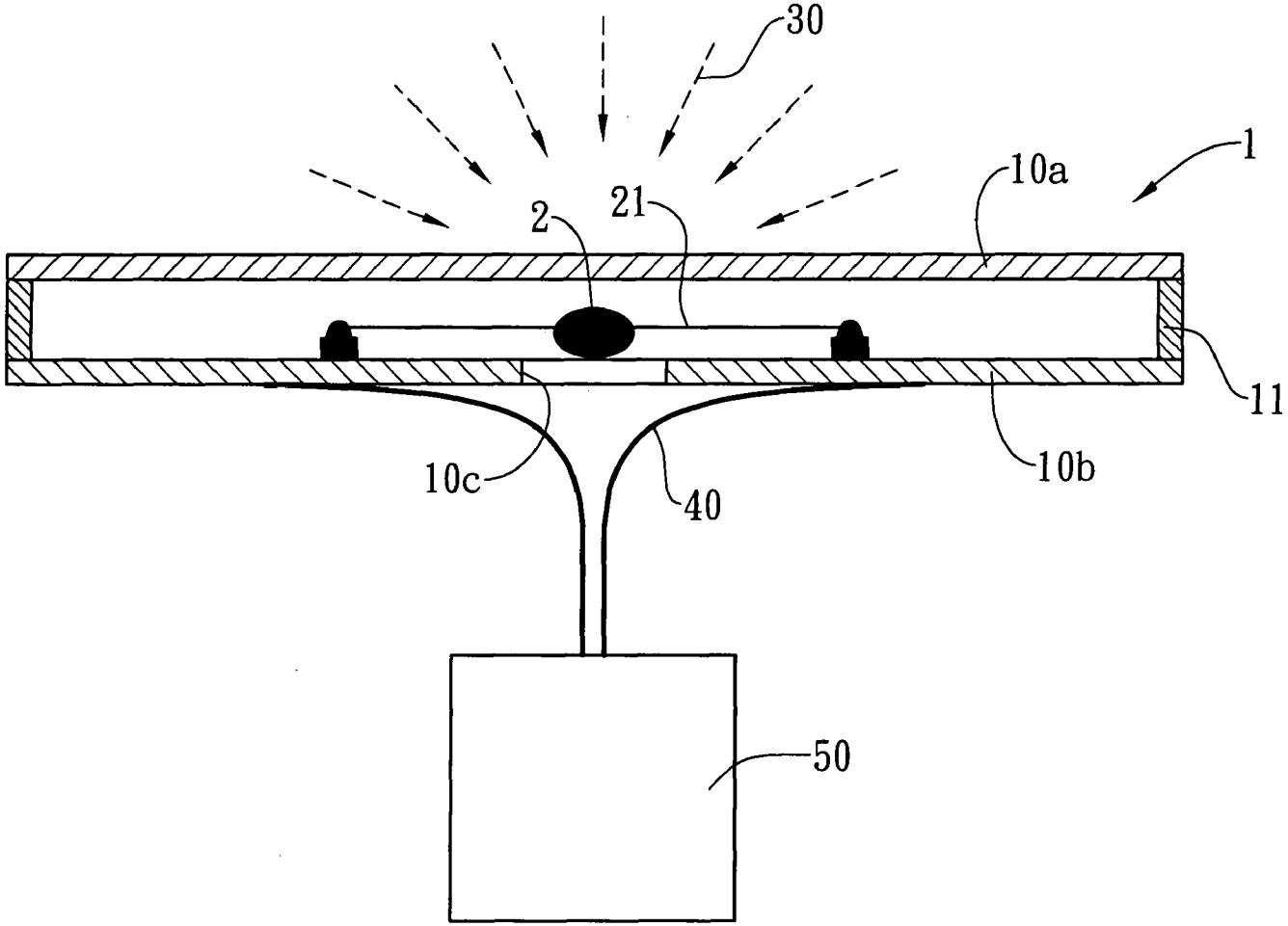
FIG. 1A to FIG. 1C is schematic cross-sectional views of the present panel module corresponding to various stages of the present method.
Figure 1B:
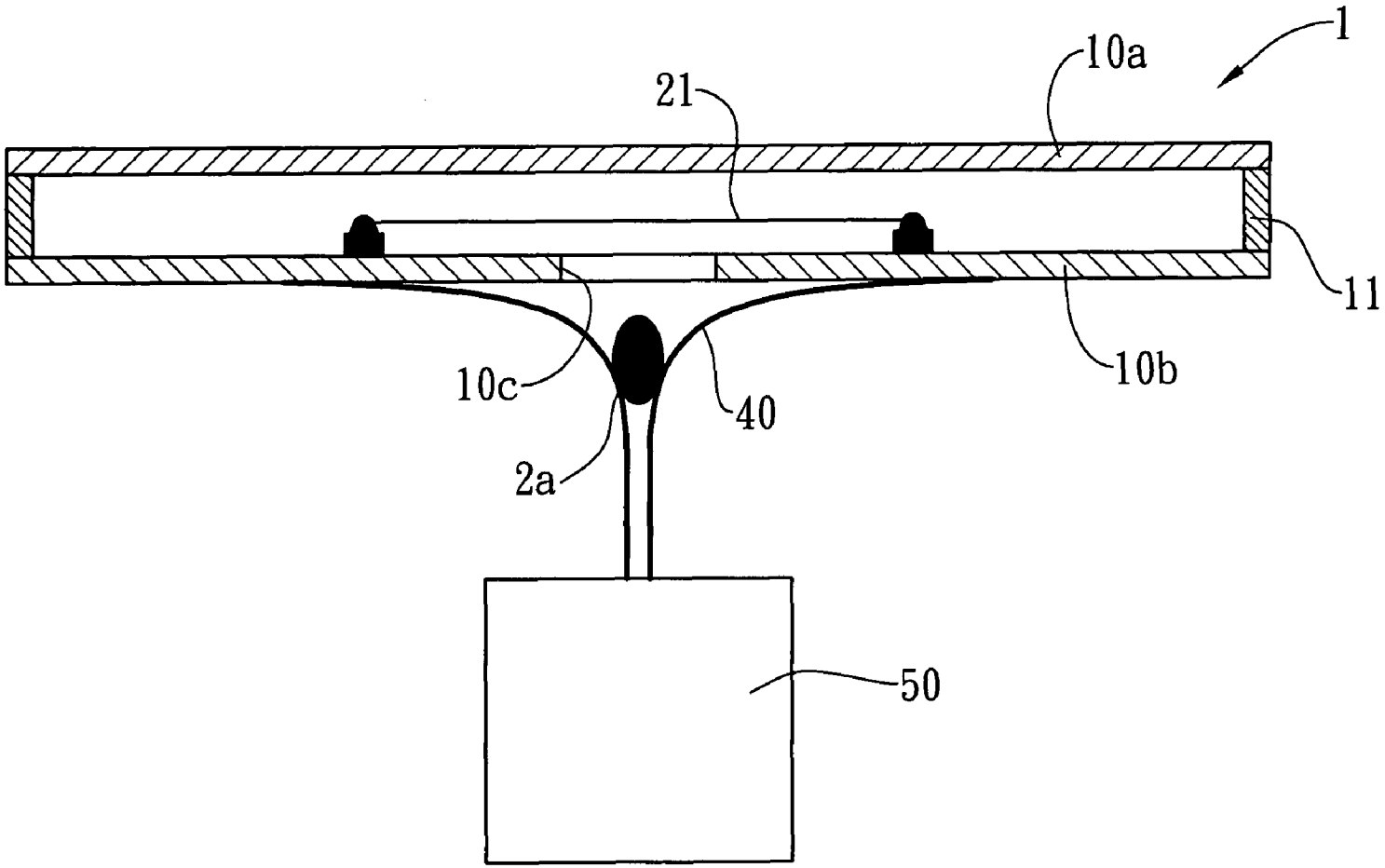
Figure 1C:
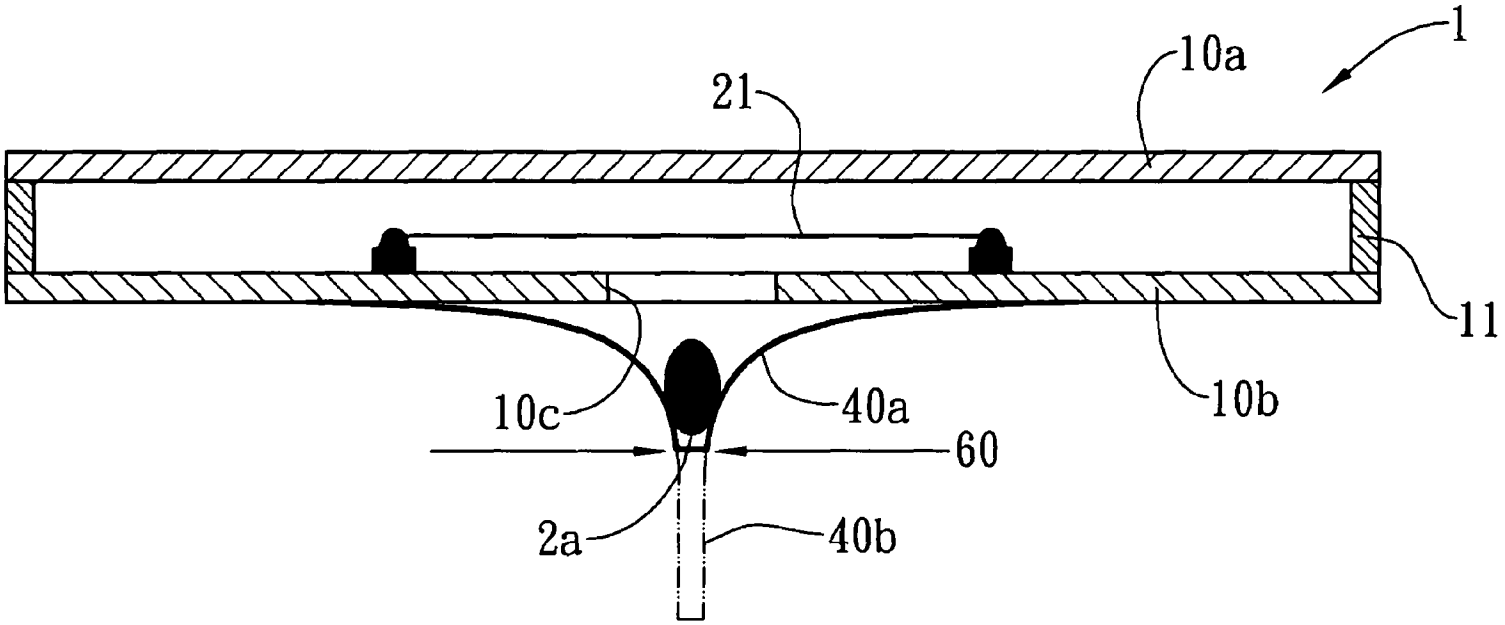

Referring to FIG. 1A to FIG. 1C, which is schematic cross-sectional views of the panel module corresponding to various stages of the present method, the present panel module 1 includes a first substrate 10*a*, a second substrate 10*b* and a side frame 11 disposed between the first substrate 10*a* and the second substrate 10*b*. The second substrate 10*b* has an exhaust opening 10*c* formed therein. An exhaust tube 40 has one end connected to the exhaust opening 10*c* and the other end connected to a pumping system 50.

A conductive member 21 serving as a suspending element is disposed right above the exhaust opening 21 within the panel module 1. The conductive member 21 has excellent thermal conductivity. The conductive member 21 is used to suspend a sealing material 2 right above the exhaust opening 10*c*. The sealing material 2 preferably is an inorganic compound with a melting point in a range of 420° C. to 450° C., such as a glass-powder pill. It should be noted that the projection of the sealing material 2 upon the cross-sectional area of the exhaust tube 40 is at least larger than the smallest cross-sectional area of the exhaust tube 40 so as to assure that the sealing material 2 can seal the exhaust tube 40 when the sealing material 2 drops down.

Next, referring to FIG. 1A, the inside of the panel module 1 is exhausted by the pumping system 50 through the exhaust tube 40 and exhaust opening 10*c* to attain a predetermined vacuum. After exhausting the inside of the panel module 1, the sealing material 2 is heated by high frequency waves 30. The high frequency waves 30 are transmitted to the conductive member 21 through the first substrate 10*a*, and then converting to thermal energy though the conductive member 21. The thermal energy is delivered to the sealing material 2. Then, the sealing material 2 is heated and molten to drop down to seal one end of the exhaust tube 40. Once the sealing material 2 is hardened, and sealing the exhaust tube 40, as shown in FIG. 1B, ambient air is prohibited from flowing into the panel module 1. The vacuum-tight of the panel module 1 is maintained.

Finally, the exhaust tube 40*b* is burnt out by hydrogen-oxygen torch. The panel module 1 with required vacuum-tight is accomplished, as shown in FIG. 1C.

Figure 2A:
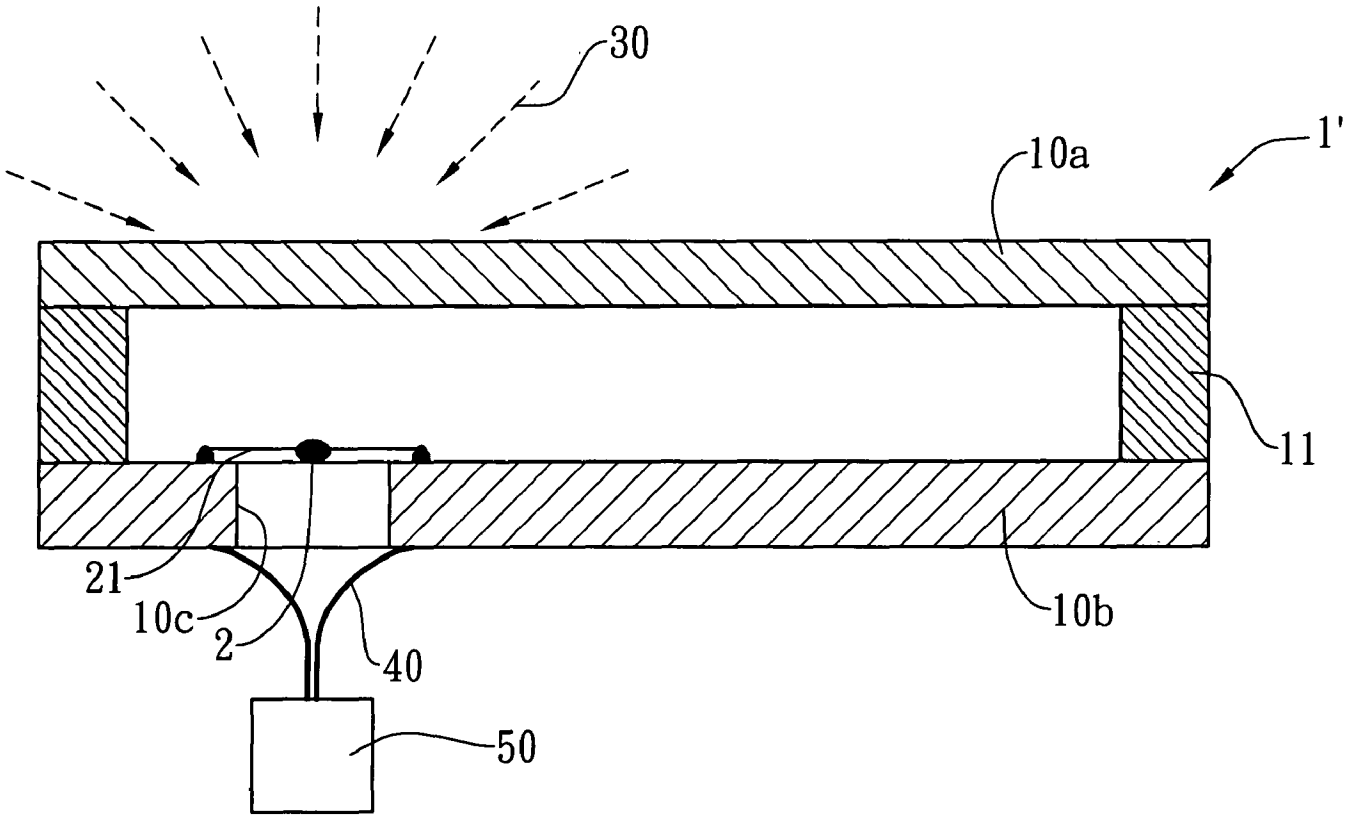
FIG. 2A to FIG. 2C is schematic cross-sectional views of the present array-like light source panel module corresponding to various stages of the present method; and FIG. 3A to FIG. 3B is schematic cross-sectional views of a conventional panel module corresponding to various stages of a known method for maintaining vacuum-tight of the conventional panel module.
Figure 2B:
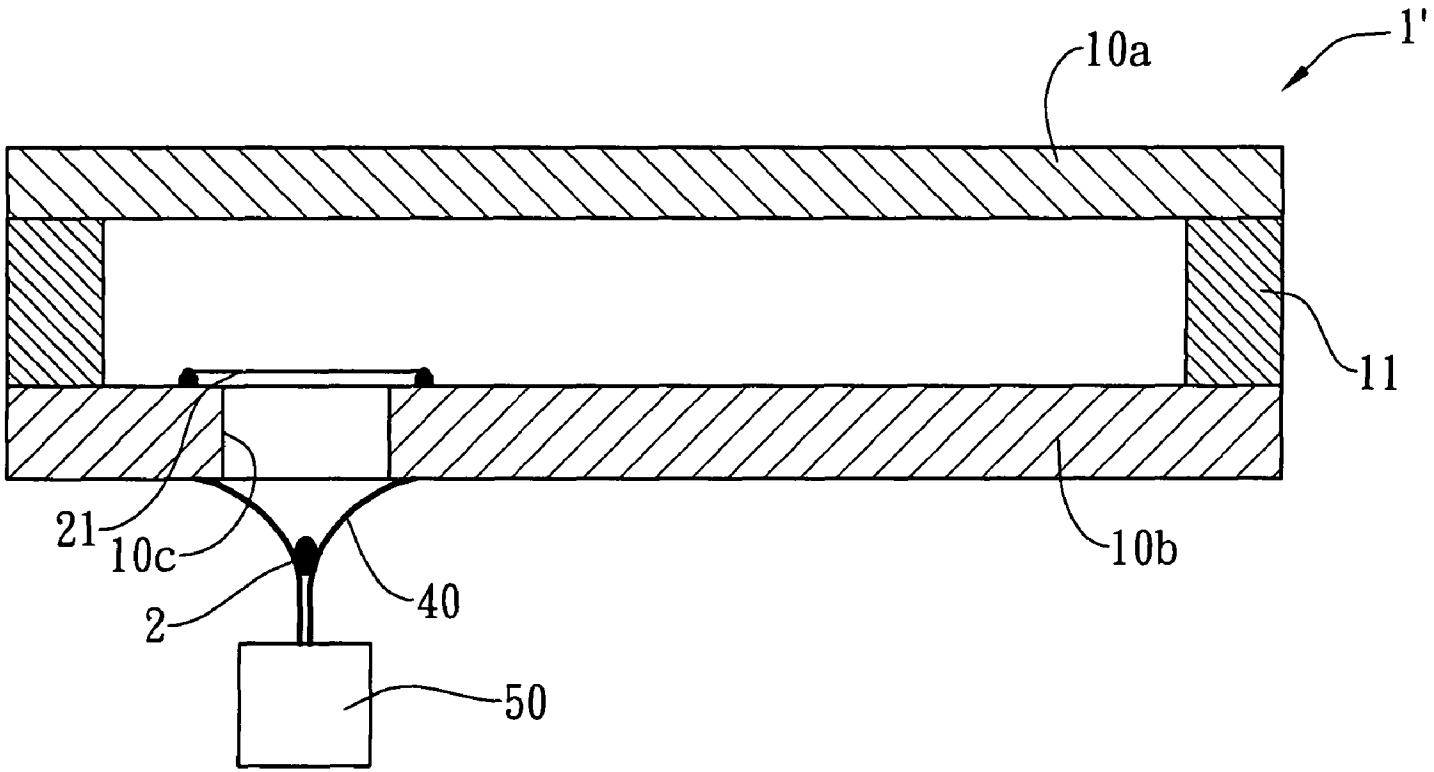
Figure 2C:
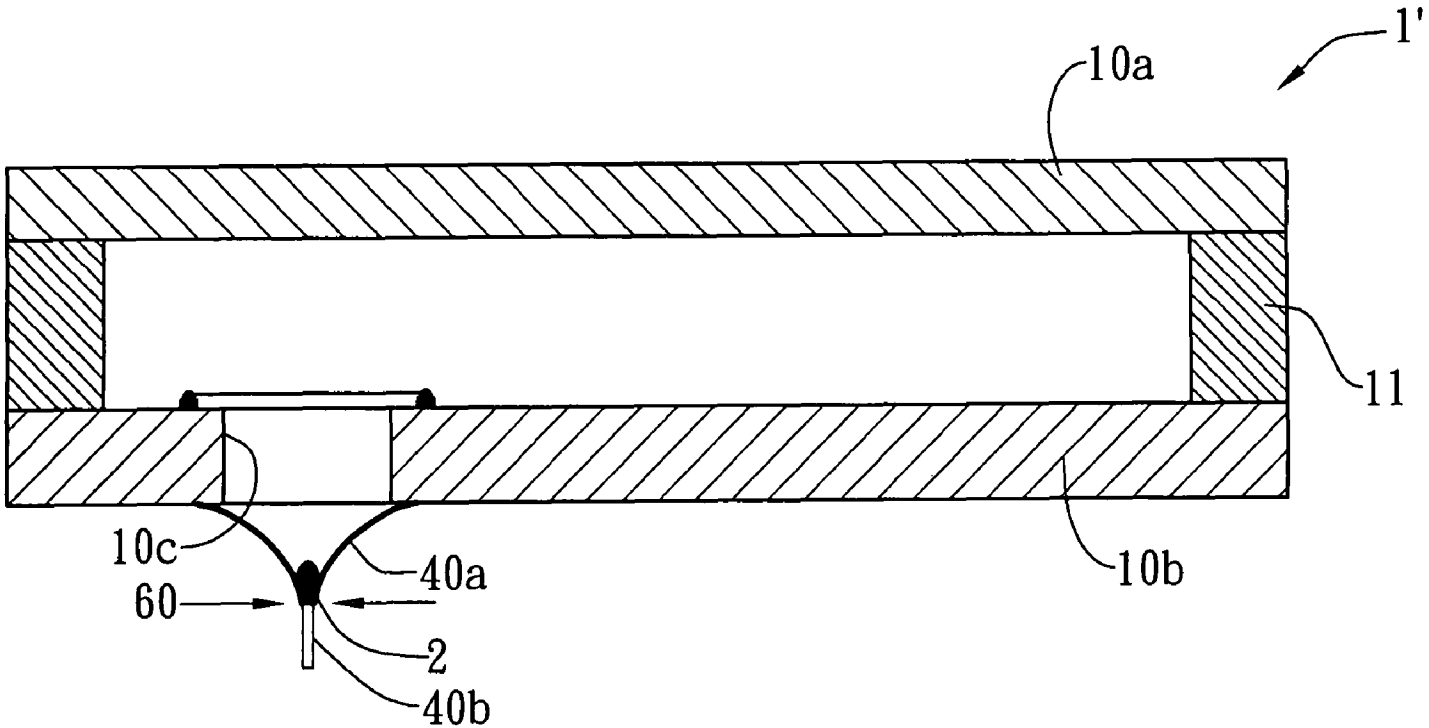
Figure 3A:
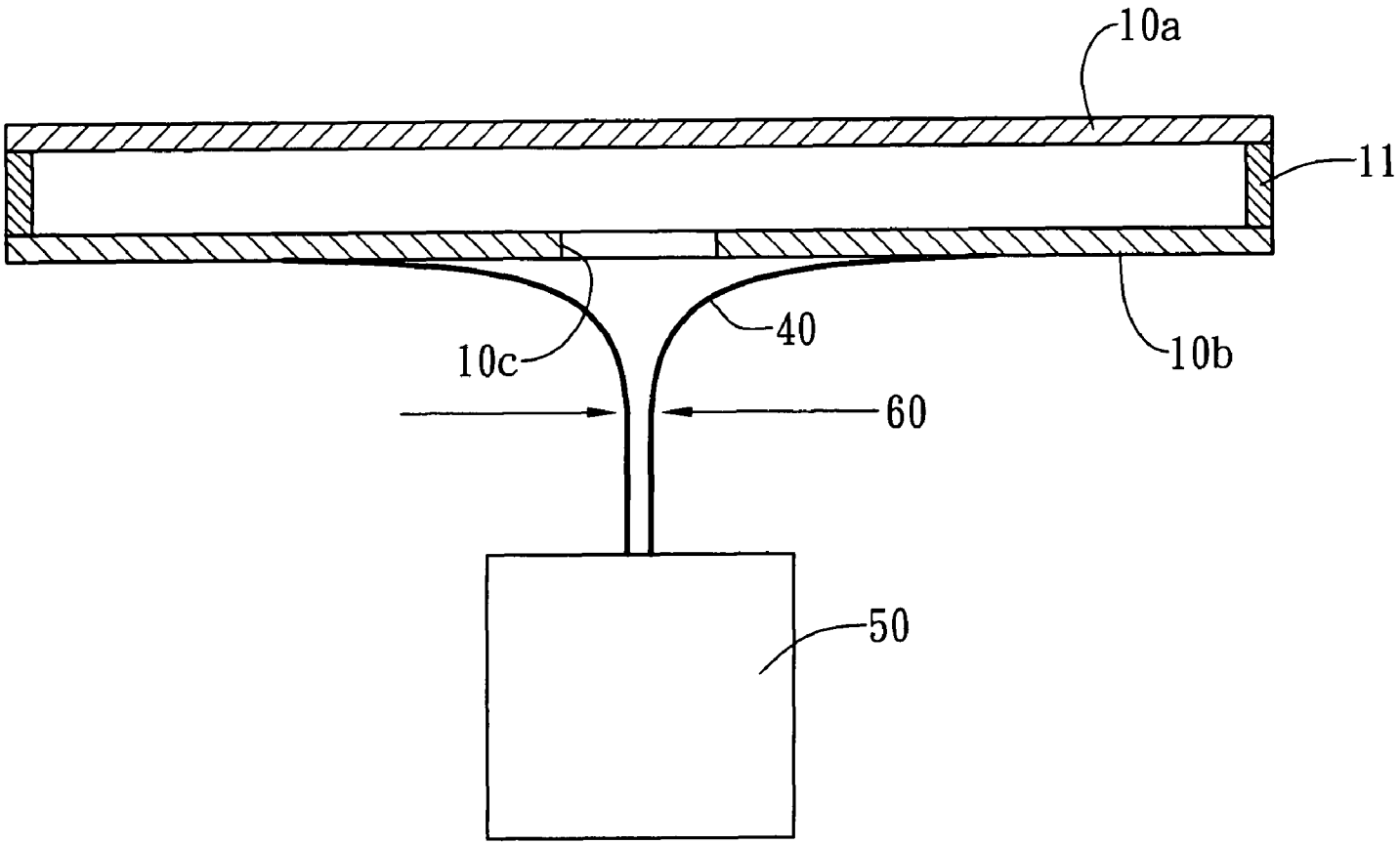
Fig. 3A (Prior Art)
Figure 3B:
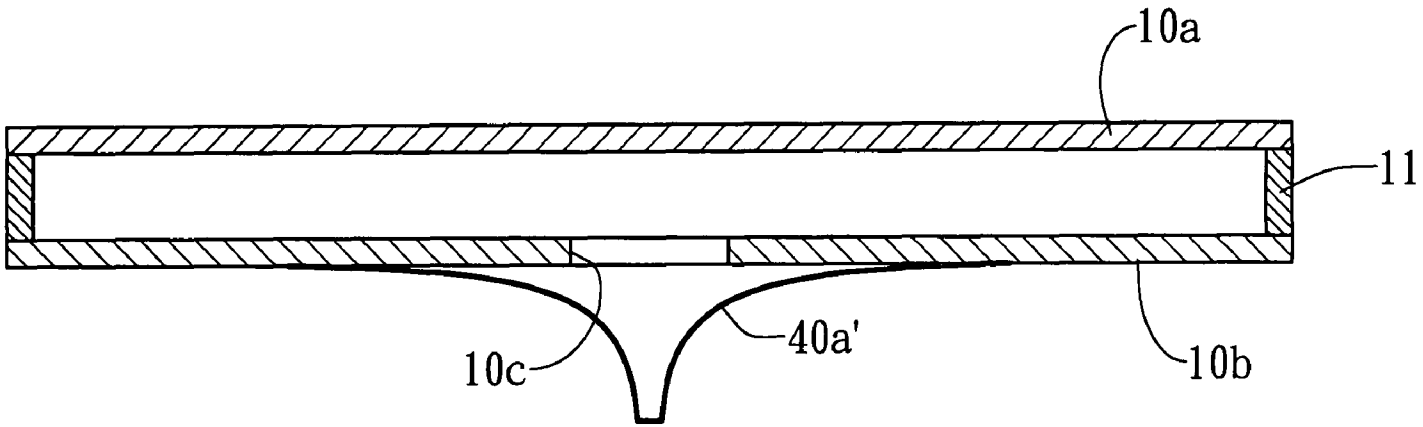
Fig. 3B (Prior Art)

FIG. 2A to FIG. 2C is schematic cross-sectional views of an application of the present panel module, which is applicable in an array-like flat light source, such as a field emission panel module. The panel module used in the array-like flat light source mainly includes a first substrate 10*a*, a second substrate 10*b*, and a side frame 11 disposed between the first substrate 10*a* and the second substrate 10*b*. An exhaust opening 10*c* is formed in the second substrate 10*b* and a conductive member 21 with excellent thermal conductivity is disposed above the second substrate 10*b* to serve as a suspending element. The conductive member 21 suspends an inorganic sealing material 2 with a melting point in a range of 420° C. to 450° C. right above the exhaust opening 10*c*. The projection of the sealing material 2 upon the cross-sectional area of the exhaust tube 40 is at least larger than the smallest cross-sectional area of the exhaust tube 40 to assure that the sealing material 2 seals the exhaust tube 40 when the sealing material 2 drops down. The exhaust tube 40 has one end connected to the exhaust opening 10*c* and the other end connected to the pumping system 50.

Referring to FIG. 2A Again, the inside of the panel module 1' is exhausted to attain a predetermined vacuum. After exhausting the inside of the panel module 1', the sealing material 2 is heated by high frequency waves 30. The high frequency waves 30 are transmitted to the conductive member 21 though the first substrate 10*a*, and converting to thermal energy by the conductive member 21. The thermal energy is delivered to the sealing material 2. The sealing material 2 is heated and molten to drop down to seal the exhaust tube 40. After the sealing material 2 is hardened, as shown in FIG. 2B, ambient air is prohibited from flowing into the panel module 1', and the vacuum-tight inside the panel module 1' is hence maintained.

Finally, the exhaust tube 40*b* is burnt out by hydrogen-oxygen torch. The panel module 1' with required vacuum-tight is accomplished, as shown in FIG. 2C.

While the invention has been described by way of examples and in terms of preferred embodiments, it is to be understood that those who are familiar with the subject art can carry out various modifications and similar arrangements and procedures described in the present invention and also achieve the effectiveness of the present invention. Hence, it is to be understood that the description of the present invention should be accorded with the broadest interpretation to those who are familiar with the subject art, and the invention is not limited thereto.

What is claimed is:

1. A high vacuum panel module, comprising:

a first substrate;

a second substrate having an exhaust opening;

a side frame disposed between said first substrate and said second substrate;

an exhaust tube connected to said exhaust opening;

a sealing material sealing and blocking an inner aperture of said exhaust tube; and a conductive member disposed inside said panel module that suspends said sealing material above said exhaust opening before said sealing material is heated and molten.

2. The high vacuum panel module as claimed in claim 1, wherein said sealing material is an inorganic material.

3. The high vacuum panel module as claimed in claim 2, wherein said inorganic material has a melting point in a range of 420° C. to 450° C.

4. The high vacuum panel module as claimed in claim 2, wherein said high vacuum panel module is a field emission display module.

5. The high vacuum panel module as claimed in claim 3, wherein said inorganic compound is a glass-powder pill.

6. The high vacuum panel module as claimed in claim 1, wherein a projection of said sealing material upon a cross-section area of said exhaust tube is at least larger than a smallest cross-sectional area of said exhaust tube.

7. A high vacuum panel module, comprising:

a first substrate;

a second substrate having an exhaust opening;

a side frame disposed between said first substrate and said second substrate;

an exhaust tube connected to said exhaust opening;

a sealing material sealing and completely blocking an inner aperture of said exhaust tube; and a conductive member disposed inside said panel module that suspends said sealing material above said exhaust opening before said sealing material is heated and molten.

8. A high vacuum panel module, comprising:

a first substrate;

a second substrate having an exhaust opening;

a side frame disposed between said first substrate and said second substrate;

an exhaust tube connected to said exhaust opening; and a sealing material suspended by a conductive member inside of said panel module;

wherein a projection of said sealing material upon a cross-sectional area of said exhaust tube is at least larger than a smallest cross-sectional area of said exhaust opening.

9. The high vacuum panel module of claim 8, wherein said sealing material is suspended right above said exhaust opening.

* * * * *